US008033755B2

(12) United States Patent
Stööd et al.

(10) Patent No.: US 8,033,755 B2
(45) **Date of Patent: *Oct. 11, 2011**

(54) SAFETY DEVICE, DIVING EQUIPMENT AND SAFETY METHOD FOR SCUBA DIVING

(75) Inventors: Jan Stööd, Hammarö (SE); Ola Patriksson, Karlstad (SE); Christian van Oostrum, Karlstad (SE); Thomas Erdtman, Santa Pola (ES)

(73) Assignee: Consensum AS, Honefoss (NO)

( * ) Notice: Subject to any disclaimer, the term of this patent is extended or adjusted under 35 U.S.C. 154(b) by 477 days.

This patent is subject to a terminal disclaimer.

(21) Appl. No.: 12/093,766

(22) PCT Filed: Nov. 20, 2006

(86) PCT No.: PCT/SE2006/050493

§ 371 (c)(1),
(2), (4) Date: Oct. 6, 2008

(87) PCT Pub. No.: WO2007/058615

PCT Pub. Date: May 24, 2007

(65) Prior Publication Data

US 2009/0217927 A1 Sep. 3, 2009

(30) Foreign Application Priority Data

Nov. 18, 2005 (SE) ..... 0502557

(51) Int. Cl.
*B63C 11/02* (2006.01)

(52) U.S. Cl. ..... 405/186; 405/185; 441/96

(58) Field of Classification Search ..... 405/185, 405/186; 441/88, 90–97, 108; 2/69
See application file for complete search history.

(56) References Cited

U.S. PATENT DOCUMENTS

| | | | | |
|---|---|---|---|---|
| 3,898,705 | A | 8/1975 | Schuler | |
| 4,051,846 | A * | 10/1977 | McClure, III | 128/202.14 |
| 4,176,418 | A | 12/1979 | Scott | |
| 5,496,136 | A * | 3/1996 | Egan | 405/186 |
| 5,560,738 | A | 10/1996 | Noel | |
| 5,746,543 | A | 5/1998 | Leonard | |
| 6,666,623 | B1 | 12/2003 | Greene | |

FOREIGN PATENT DOCUMENTS

| | | |
|---|---|---|
| EP | 0278598 A1 | 8/1988 |
| EP | 0615899 A2 | 9/1994 |
| WO | 9813255 A1 | 3/1998 |

OTHER PUBLICATIONS

Office Action issued in corresponding Swedish Patent Application No. 0502557-2, mailed Nov. 26, 2008. Supplementary European Search Report (completed May 18, 2011).

* cited by examiner

*Primary Examiner* — John Kreck
*Assistant Examiner* — Sean Andrish
(74) *Attorney, Agent, or Firm* — Jeffrey S. Melcher; Manelli Selter PLLC

(57) ABSTRACT

The present invention relates to a method in connection with SCUBA diving to control a diver's buoyancy, in which method the diver (11) is equipped with diving equipment comprising at least one air pressure tank (1), a valve device (2) connected to the pressure tank (1) and arranged to supply air from said pressure tank via first supply means (5) to a breathing regulator (4) and via second supply means (7) to an inflatable diving jacket (6) in order to control the diver's buoyancy, inflation of the diving jacket being initiated when the diver has not affected the air flow through the breathing regulator (4) for a certain time period. The invention also relates to a safety device and diving equipment.

24 Claims, 5 Drawing Sheets

SAFETY DEVICE, DIVING EQUIPMENT AND SAFETY METHOD FOR SCUBA DIVING

CROSS-REFERENCE TO RELATED APPLICATIONS

This application is a national stage entry under 35 U.S.C. 371 of International Application No. PCT/SE2006/050493, filed 20 Nov. 2006, designating the United States. This application claims foreign priority under 35 U.S.C. 119 and 365 to Swedish Patent Application No. 0502557-2, filed 18 Nov. 2005.

TECHNICAL FIELD

The present invention relates to a safety device, diving equipment and a safety method in connection with SCUBA diving, for controlling a diver's buoyancy, in which the diver is equipped with diving equipment comprising at least one air pressure tank, a valve device connected to the pressure tank and arranged to supply air from said pressure tank via a first flexible tube to a breathing regulator and via a second flexible tube to a partially inflatable diving jacket in order to control the diver's buoyancy, and an actuator arranged to communicate with said valve device in order to initiate inflation of the diving jacket. Moreover, the invention relates to a device for controlling a diver's buoyancy.

PRIOR ART

In skin diving with dive tanks, so called SCUBA diving (Self Contained Underwater Breathing Apparatus), the diver is provided with air from pressure tanks that he carries with him during the dive. For obvious reasons it is extremely important that the diving takes place in an appropriate way in order for accidents not to occur. Most persons that plan to dive choose to participate in training before starting to dive for real. Throughout the years, many appliances have been developed in order to prevent accidents in connection with diving. One example is the inflatable diving jacket carried by the diver, which helps him to control buoyancy and which is used in combination with weights in order to help the diver to descend. Examples of other appliances are tables and portable dive computers that help the divers to plan diving in order not to risk the bends or having to surface quickly because air is running out e.g. The diving equipment itself has also developed and has been provided with devices that aim to prevent accidents. Most of these devices have the object of sensing any problems arising or to facilitate for the diver during a dive.

One situation that quite frequently results in near-accidents and sometimes in drowning is when the diver for some reason is suffering from stress as he surfaces. A standard protocol is that when the diver surfaces he should first secure his own buoyancy by air filling the diving jacket before removing the breathing regulator from the mouth. The fact that it is less strenuous to breathe atmospheric air above the surface than to breathe through the breathing regulator sometimes makes the diver, in a stressful situation, throw out his breathing regulator directly upon surfacing. Alternatively, the diver wants to draw other peoples' attention by shouting to an assistant. If a diver in that situation does not succeed in securing his own buoyancy by air filling the diving jacket, he will soon begin to sink due to the weight of the diving equipment. In that situation he has a very short time to find the inflation actuator for the diving jacket. Of course, the situation is worsened by the diver primarily searching for his breathing regulator in order to be able to breathe below surface, instead of primarily searching for the actuator for air inflation of the diving jacket. For this reason, accidents have occurred in which people have drowned despite diving in water with a depth of no more than two meters.

Safety devices in connection with diving equipment are previously known, which intend to give improvement in respect of the shortcomings described above. From FR 2741853 it is e.g. known such a device that comprises sensors in combination with actuation means in order, in connection with certain predetermined conditions, to initiate inflation of a diving jacket in order to eliminate situations of potential drowning. The system however suffers from several drawbacks. One important drawback is that it is essentially based on use of electronics, which results in availability risks, in form of the continuous need of a functioning current supply as well as the need to keep out moisture and condensation. The suggested sensor portion is furthermore related to the measuring of exterior breathing movements of an individual, using the frequency as an indicator, which means several drawbacks, among other things because chest movements not necessarily have to be coupled to breathing movements.

A device is further known from EP 034569, having a system that is intended to automatically inflate a life jacket upon cessation of breathing. The suggested system however suffers from many functional and/or constructional drawbacks. As an example of such a drawback, the use of a compressible cellular foam-rubber slab as the actuation mechanism, can be mentioned. Such an actuation mechanism means significant safety risks as it is exposed to wind and weather and thereby easily gets dirty etc., which may affect its function. Moreover, it can only actuate at a depth of about 2-3 meters below surface. As mentioned, many near-drowning accidents take place at a depth of much less than 2 meters.

A safety system is furthermore known from U.S. Pat. No. 4,176,418, which is intended to result in automatic inflation of a diving jacket upon cessation of breathing. This device too has many drawbacks. Firstly, there is no automatic sensing of whether the used actuator should be in active or inactive mode, but instead a valve must be manual manoeuvred to active or inactive mode, which is an obvious safety risk. Another important difference is that traditional standard equipment can not be connected to this device since it is based on the employment of a special valve device integrated with a reducing valve, thus resulting in a very complex construction that among other things comprises two separate pressure chambers.

In U.S. Pat. No. 5,746,543 it is further shown a device that stated to aid the diver in automatic control of buoyancy. The device contains a microprocessing unit, three pressure sensors and intake and exhaust valves that act together in order to control buoyancy. By a switch mechanism, the diver can choose the function of the microprocessing unit, e.g. Set Neutral Buoyancy, Maintain Neutral Buoyancy, Maintain Depth or Ascend. In order to achieve the Ascend function the switch mechanism must however be held down all the time. The microprocessing unit adapts the ascent rate in dependence of the depth in question of the diver and it also plans for safety stops if required. Also U.S. Pat. No. 6,666,623 discloses a similar device. This device too comprises a microprocessing unit that is programmed to automatically control and adjust buoyancy by inflation of the diving jacket or by releasing air from the same. Hereby, the diver's ascent rate to surface can be switched between two positions, a normal position and an emergency position. The emergency position must however be activated manually.

In U.S. Pat. No. 5,560,738 it is further shown yet a variant of a safety device in connection with diving. According to this device there is provided equipment to control that a diver is not at a depth at for which he doesn't have enough air left in the pressure tank. In the event that the device detects that the pressure tank does not contain enough air, the device will automatically inflate the diver's jacket such that the diver will ascend. The device can also be set to achieve an automated ascent up to surface if the diver descends to a predetermined maximum depth.

BRIEF ACCOUNT OF THE INVENTION

It is an object of the present invention to provide an improved safety method in connection with SCUBA diving. This is achieved by initiating inflation of the diving jacket if the diver has not affected the flow of air through the breathing regulator for a certain predefined time. The invention also relates to a safety device for achieving this safety method.

Thanks to the invention, a diver that would otherwise risk drowning will be safely brought up to the water surface. By the method being based on sensing whether the diver breathes in his breathing regulator, the safety device can be arranged to initiate inflation of the diving jacket in situations in which normal safety systems would not detect the emergency, for example if the diver is apparently under control close to the water surface but without breathing in his breathing regulator (for a certain predefined time), which could for example be the case due to heart problems.

In a preferred embodiment, the safety device is operated by air from the pressure tank, which means that the safety device will have high reliability. A preferred device according to the invention is also characterised in that it is affected only by a few components that are suitably known per se at the market, whereby product costs can be kept down. According to a preferred embodiment, the safety device is easy to connect to existing diving equipment or it can be integrated in new equipment, for example at the connection of the pressure tank to the jacket or integrated in a dive computer. Thereby, safety in connection with SCUBA diving can be considerably improved in a flexible way and at a relatively reasonable cost. By being able to use the invention in principle in combination with existing equipment independent of the make, a diver may continue to use the equipment that he is most comfortable with, resulting in additional synergy in respect of safety.

In order not to risk injuries due to rapid ascent from a large depth to the water surface, the method is primarily intended to initiate inflation of the jacket when the diver is (or recently has been) in a position close to the water surface. This is suitably achieved by providing the diving equipment with an actuator that initiates inflation of the diving jacket when the diver is in an actuation zone just below the water surface. Amongst so called surface related accidents there are the accidents that are characterised by the diver for some reason not having been able to secure his buoyancy by inflating the diving jacket, but instead sinking below the surface. If for example the diver surfaces after an ascent and for some reason he is under stress, a common and irrational behaviour is that the diver throws out his breathing regulator directly, despite having been taught first to secure buoyancy. If the diver then fails to secure buoyancy at surface by inflating the diving jacket, he will soon start to sink below the surface again since the diving equipment has weights to help the diver to stay under water. Without a breathing regulator in the mouth, the diver will start to breathe in water within approximately 15-30 sec. Following the first swallowing of water the diver loses consciousness after a very short time. The diver will then sink very rapidly due to the weight of the diving equipment. In order to be successful, a rescue operation must in principle take place before the events have progressed to the point at which the diver loses consciousness.

According to yet another aspect of the invention, the actuator is preferably actuated if the diver is within an actuation zone A that is limited by an upper predefined actuation depth D1 and a lower predefined actuation depth D2. Hereby, the advantage is also attained that the jacket is prevented from being inflated if the diver is at a depth from which a direct ascent to surface is not desirable/suitable. Such a situation can arise if the diver is out of own air but receives air from the equipment of another diver. In order to prevent lung rupture during ascent and in order to vent absorbed nitrogen to body tissues, safety stops must be made at certain intervals during ascent. Inflation of the diving jacket in such a situation constitutes a direct life threat. It also occurs that divers take off the diving equipment for a short time period when deep down in order to penetrate narrow spaces. For such short periods special breathing regulators with small integrated pressure tanks enough for a few minutes of diving can be used. For that reason, the upper predefined actuation depth suitably corresponds to a depth of between immediately below the water surface to a depth of 1 m, preferably 0.1-0.5 m, more preferred 0.1-0.3 m, most preferred about 0.2 m below water surface, and the lower predefined actuation depth corresponds to a depth chosen in consideration to preferences, e.g. a depth immediately above the usual depth for so called safety stops in connection with ascendance to surface, preferably 2-5 m, more preferred 3 m, most preferred about 2.5 m below water surface.

By the actuator preferably comprising a pressure sensing means that detects the diver's depth D, the advantage is attained that as soon as the diver enters the actuation zone the safety system is automatically activated while the system prevents inflation of the diving jacket when the diver is at a depth from which a rapid ascent to surface would be a serious health hazard. Whether the diver enters the actuation zone on his way down or on his way up to the surface is of no importance in this connection. By all components of the safety device only requiring pressurized air for operation, which pressurized air is always available from the pressure tank, a very reliable safety method can be provided. Of course the actuation zone can be adapted as desired and in dependence of how the diving in question is to take place.

Additional aspects of the invention are clear from the additional dependent claims and from the description.

In addition to this, the safety method and the safety device according to the invention should also contribute to the achievement of one, some or preferably most of the objects listed below:

- the safety device can be installed on existing diving equipment,
- the safety device can be moved from one set of diving equipment to another,
- the safety device should have high reliability,
- the safety device can offer manual inflation of the diving jacket in connection with a near-accident,
- a sole diver can be provided with better safety against diving related accidents,
- manual setting of the actuation zone depth,
- when diving in shallow water (not more than 3-5 m), in connection with training e.g., the safety system can be continuously active, which will lead to improved safety for inexperienced divers,
- manual actuation of the safety system can be offered, which could be an advantage in connection with training in which the safety system can be actuated already on land for training purposes as well as from a safety point of view, actuation by remote control can be offered, e.g. in combination with a dive computer, wireless transmission/reception, the safety system can be connected to (or be integrated in) a dive computer.

BRIEF DESCRIPTION OF THE DRAWINGS

In the following, the invention will be described in greater detail with reference to the attached drawing figures, of which.

DETAILED DESCRIPTION OF THE INVENTION

Figure 1:
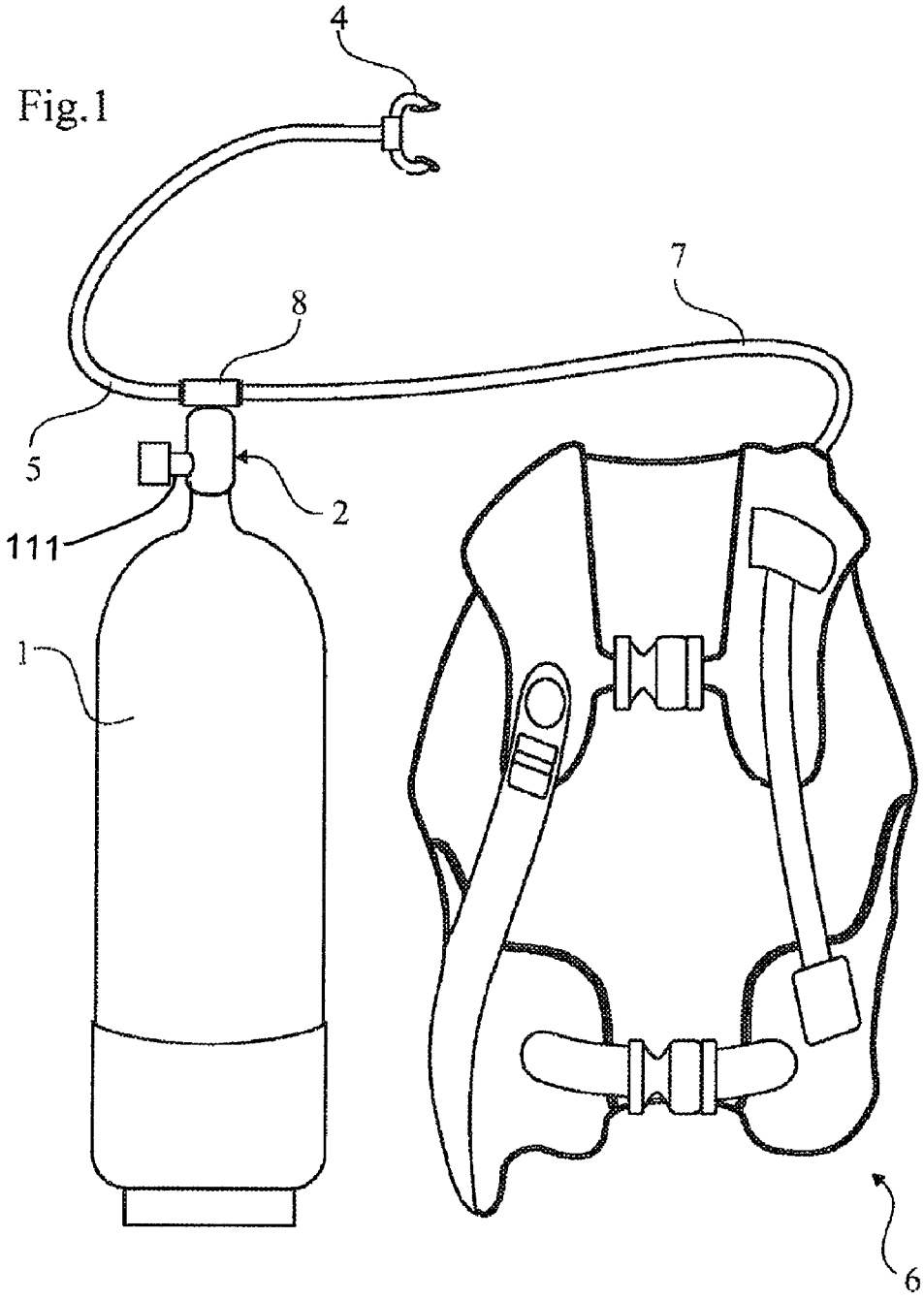
FIG. 1 schematically shows a set of diving equipment according to a preferred embodiment of the invention.

FIG. 1 shows a set of diving equipment used in connection with SCUBA diving. The equipment comprises at least one pressure tank 1, a valve device 2 connected to the pressure tank and arranged to supply air from said pressure tank via a first flexible tube 5 to a breathing regulator 4. The valve device 2 is also arranged to supply air from the pressure tank to a so called diving jacket 6. The diving jacket 6, which is inflatable, is carried by the diver and it is used to control his buoyancy. The diving jacket 6 is supplied with air via a second flexible tube 7 from the pressure tank. The diving equipment further comprises an actuator 8 that is arranged to communicate with said valve device 2 in order to initiate inflation of the diving jacket 6. Suitably, the actuator 8 is connected with the valve device 2 such that the connection them between is flexible, e.g. in the form of an intermediate elastic tube means (not shown) that allows for a certain pliability with the purpose of preventing impacts or knocks from resulting in large forces on the connection.

Figure 2:
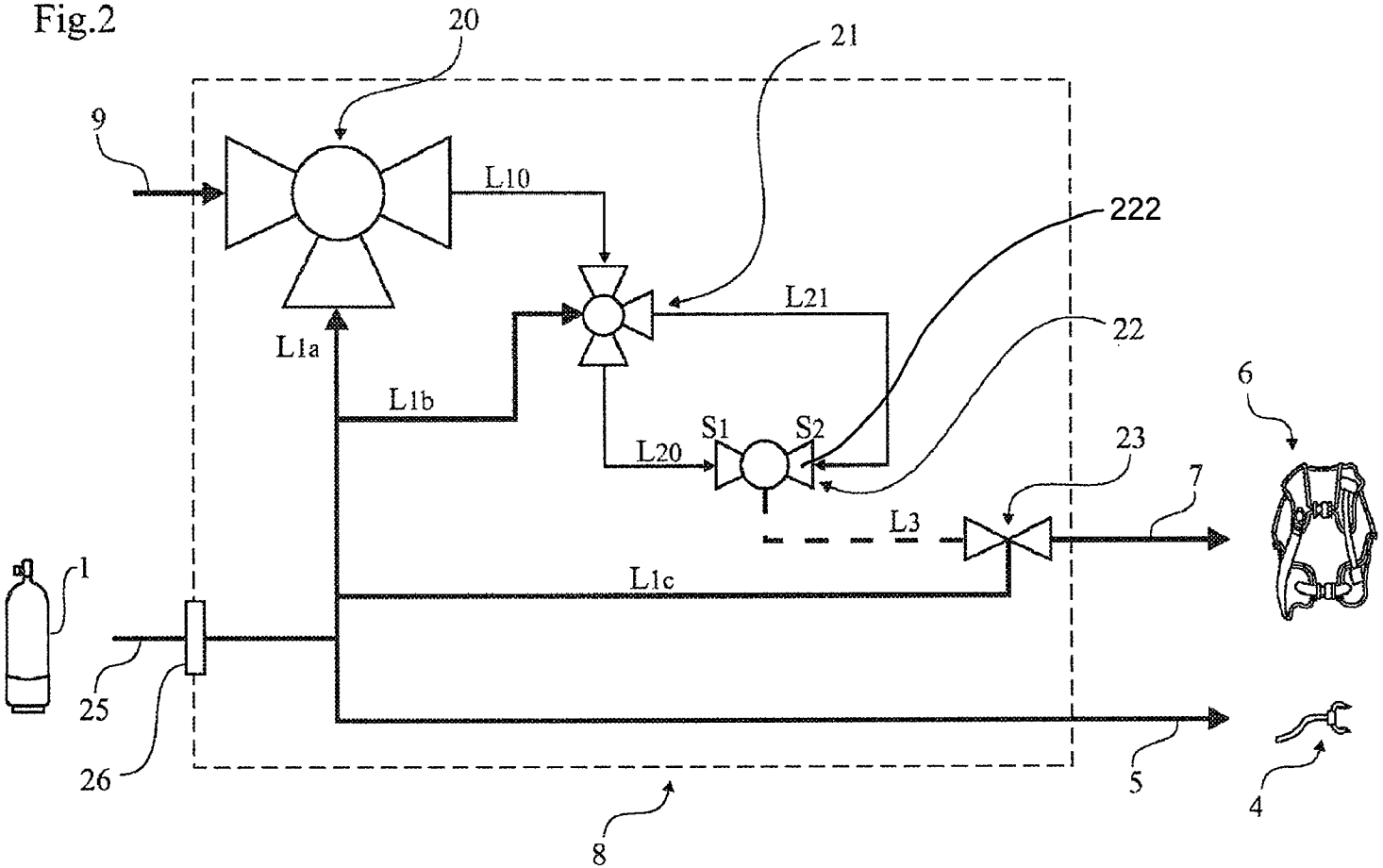
FIG. 2 shows a flowchart over the actuator according to the invention.

FIG. 2 shows a flowchart over an embodiment of the actuator 8 according to the invention and the components included therein. The actuator comprises a pressure sensing valve 20 that via a first connection L1*a* is in fluid communication with an outlet 25 from the valve device 2. Furthermore, the actuator 8 comprises a diaphragm valve 21 (or the like) that via a second connection L1*b* is in fluid communication with an outlet 25 from the valve device 2, and that via an outlet L10 is in fluid communication with the pressure sensing valve 20. In its turn, the diaphragm valve 21 is in connection with a delay means 22. There is a third connection L20 between the diaphragm valve 21 and a first side S1 of the delay means 22. There is a fourth connection L21 between the diaphragm valve 21 and a second side S2 of the delay means 22. In addition, the actuator 8 comprises a triggering valve 23 that via a sixth connection L3 is in fluid communication with the delay means 22. The triggering valve 23 is also in fluid communication with an outlet 25 from the valve device 2, via a seventh connection L1*c*, in order to be able to supply the diving jacket 6 with air from said second tube 7.

In one embodiment according to the invention the pressure sensing valve 20 is constituted by a governor valve that operates between two end positions. The valve 20 is then closed in either end position, such that air cannot be conveyed through the valve 20 and into the conduit L10 to the diaphragm valve 21. Only in the case that a pressure from the surrounding water 9 affects the valve to make its pressure sensing means to indicate predetermined values, resulting in a position in between the above mentioned end positions, the pressure sensing valve 20 will open up the connection to supply air from the pressure tank 1, via the supply conduit L1*a* and further through its outlet L10 to the diaphragm valve 21.

The diaphragm valve 21 is a directional valve that guides the incoming air from the outlet L10 in the pressure sensing valve 20 (the air flow that comes in via the supply conduit L1*a*) to flow via said third connection L20 or said fourth connection L21. When the air pressure in L1*b* is static, which air pressure acts on the diaphragm valve 21, it will direct the air to flow out into said third connection L20. When there is a change in air pressure in the conduit L1*b* (which takes place in connection with an inhalation) the diaphragm moves inside the diaphragm valve 21, which in turn affects the direction of the flow through the diaphragm valve 21 to shift from going to L20 instead to go to the fourth connection L21.

Accordingly, the only driving air flow to the diaphragm valve 21 comes via conduit L10 and when it is active the air flow is directed through the diaphragm valve either to the third supply conduit L20 or to the fourth supply conduit L21, both of which are in communication with the delay means 22.

The delay means 22 operates to forward the air flow from the third supply conduit L20 to the conduit L3 only after a certain time period has lapsed, i.e. after a certain time delay. One of the inlets SI to the delay means 22 must accordingly have been affected by an active pressure via conduit L20, in order for air to flow through the delay means 22 to the triggering valve 23. A resetting mechanism 222 is built into the delay means 22, which mechanism is coupled to the second inlet S2. This resetting mechanism 222, via the inlet S2, is activated when the diaphragm valve directs the air flow from the outlet LIO to go through the fourth supply conduit L21. This redirection takes place in its turn as soon as a pressure change is noted in the diaphragm valve 21. The air flow is accordingly deflected from LIO as soon as an inhalation takes place, which inhalation thus leads to a pressure change in the conduit Lib that is connected to the diaphragm valve. As soon as such a pressure change is perceived by the diaphragm valve 21 (i.e. a confirmation of an inhalation), the air flow from LIO will accordingly reset the delay means to its original position, such that once again there is achieved a predetermined time delay before activation of the triggering valve 23 can take place. The triggering valve 23 is a simple logic element always having one of its conduits Lie connected to the outlet from the pressure tank 1 and being activated to supply air through the flexible tube 7 as soon as it gets activated via a pressure impulse in the conduit L3 that is coupled to the delay means 22. Suitably, the end of the flexible tube 7 is provided with a spring-loaded ball valve (not shown), as is known per se, which means that the flexible tube 7 seals against air flow as soon as it is detached from the jacket 6. This also gives a simple possibility to detach the safety arrangement, if desired.

Via a coupling device 26 (only shown schematically in FIG. 2), the actuator 8 can be connected to the pressure tank 1 and the valve device 2. This coupling device 26 preferably comprises standard valve couplings, which means that the actuator 8 in principle can be fitted to all valve devices 2 on the market, independent of their make, since such devices normally are manufactured with standard couplings to be able to be fitted to different types of equipment. The valve device 2 normally comprises a reducing valve 111 (FIG. 1) that reduces the air pressure from the pressure tank 1 (normally about 20-30 MPa) such that air of a lower pressure, normally 0.8-1.1 MPa is supplied to the diving jacket 6 and the breathing regulator 4. It is however realised that in some applications, the reducing can take place in the actuator 8. It is also realised that many advantages can be attained if the actuator 8 is integrated in the valve device 2, such that these form a joint unit (not shown).

In the shown preferred embodiment, the components of the actuator are in the main mechanical components, such as pneumatic or hydraulic controlled valves. This also gives the advantage that the safety device 8 doesn't need electricity to work. Hereby, it can be operated only by air from the pressure tank 1 and be activated by external influence, such as a certain type of moisture and/or a certain water pressure. Hereby, reliability in operation will be extra high. By "a certain type of moisture" should be understood influence that doesn't comprise rain but moisture in a continuous pool of liquid (a lake, a swimming pool, the sea, etc.), whereby the presence of a hydrostatic pressure can be sensed without using a manometer, for example by sensing continuous moisture present on certain areas of the actuator.

Figure 3:
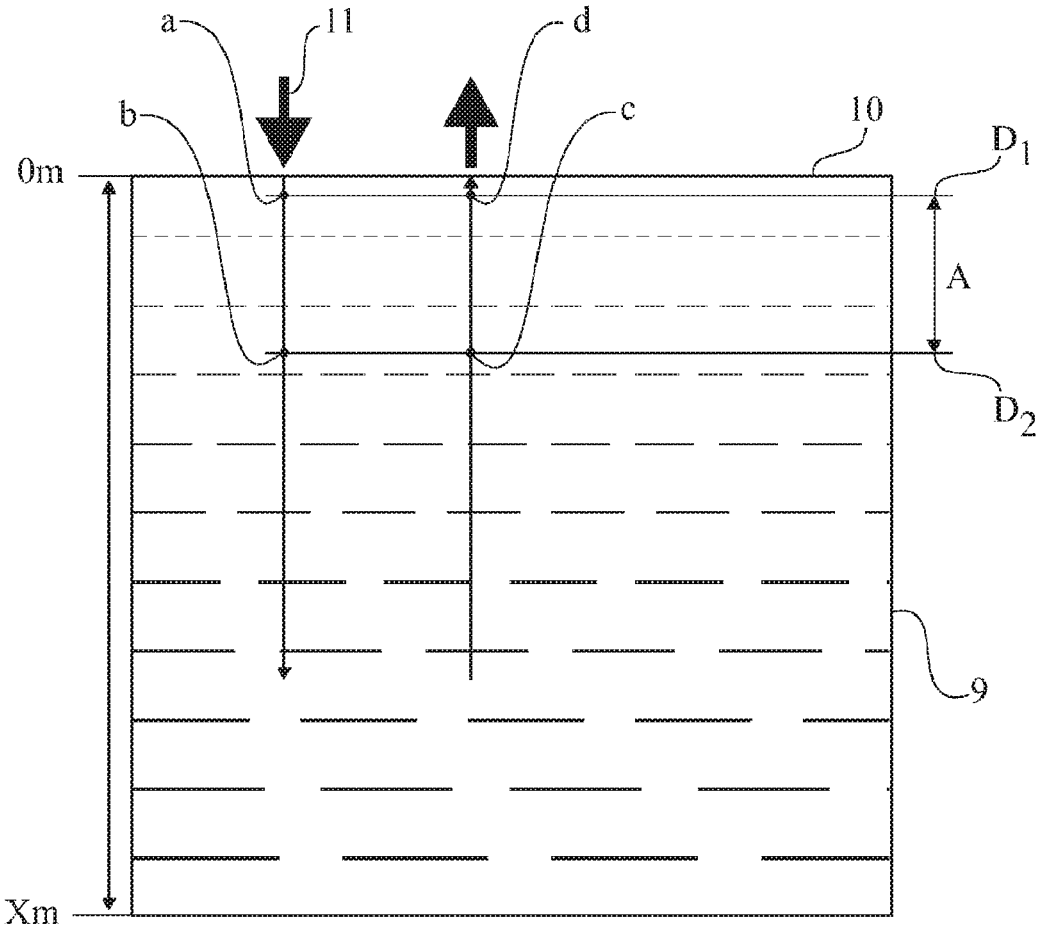
FIG. 3 shows a schematic illustration of diver using the invention.

FIG. 3 schematically shows the use of a device according to the invention. It schematically shows a vertical section through a water-filled area 9 (such as a part of a lake), with its surface 10 and down to a certain depth corresponding to about 10 meters. With the purpose of illustrating a dive with a device according to the invention, a diver 11 is furthermore symbolised by arrows, the diver 11 performing a dive while passing the points a-d in chronological order. It is also shown that a device according to the invention preferably has an actuation zone A that is defined by an upper depth D1 and a lower depth D2, respectively.

DESCRIPTION OF THE FUNCTION

With reference to FIGS. 2 and 3, the function of the device will now be described. As mentioned above, the method primarily aims to avoid serious accidents in connection with surface related situations. In a preferred embodiment, the actuator 8 is hence arranged to the activated when the diver 11 enters or is in the actuation zone A. Normally, this actuation zone A comprises a zone that extends from a depth D1, of between just below the surface to a depth of about 1 meter, normally 0.1-0.5 m, preferably 0.1-0.3 m and most preferred about 0.2 m below the surface, and down to a desired depth D2, such as 200 m, or if desired to an infinite depth, or to a depth D2 that is normally used for so called safety stops in connection with ascendance to surface, preferably 2-5 m, more preferred 3 m, most preferred about 2.5 m below water surface. If the diver doesn't take a breath in the breathing regulator 4 within a certain predefined time period, the actuator 8 will initiate inflation of the divers diving jacket 6, whereby the diver 11 will be transported up to the surface 10.

Actuation cannot take place when the diver is outside the actuation zone A, either on shore or not having commenced diving or when diving at a depth that is larger than that defined by the actuation zone A. This function, i.e. the inactive mode, is achieved by the pressure sensing valve 20 being designed to open up an actuation connection L10 under influence of an external water pressure within the range of D1-D2, which comprises the hydrostatic pressure at the upper actuation depth D1 and down to the hydrostatic pressure at the lower actuation depth D2.

At surface position or a position in which the diver 11 is just below surface 10, the valve 20 will be closed such that air cannot be supplied through its outlet conduit L10. In connection with descent the diver 11 will, at a certain point a (see FIG. 3), enter the actuation zone A since then the surrounding water 9 will exert a large enough pressure on the pressure sensing valve 20 to open up the connection via the outlet L10. Hereby, the diaphragm valve 21 will be supplied with air via the conduit L10 and further through the connection conduit L20 that leads to the delay means 22, whereby influence from start position in a direction towards trigger position is initiated. This activated mode will not be disconnected until the diaphragm valve 21 is influenced to switch, which takes place as soon as there is breathing in the breathing regulator 4, which will affect a pressure change in the connecting conduits such that the conduit L1*b* connected to the diaphragm valve 21 is influenced to switch the diaphragm valve 21. Hereby, switching of the diaphragm valve 21 is effected such that the air supplied to the outlet L10 from the pressure valve 20 is redirected inside the diaphragm valve 21 in order to discharge in the fourth connection L21, which affects a resetting of the delay means 22. This procedure will be repeated as long as the diver is within the actuation zone A. Under the condition that breathing takes place within a predefined time of delay T (which is predefined in the delay means 22), the triggering valve 23 will accordingly not be influenced via L3, which in turn means that the jacket 6 will not be inflated.

The actuation time T1 for the pressurized air to affect the delay means from start mode to trigger mode is considerably much longer, a magnitude of 10-100 times, preferably 10-20 times as long as the resetting time T2 for the pressurized air to affect the delay chamber in the opposite direction i.e. to the start mode, which resetting time T2 is not more than 2 seconds, preferably not more than 1.5 seconds and most preferred not more than 1 second.

As soon as the descending diver has passed the lower actuation depth D2, i.e. has passed point b in FIG. 3, the pressure of the surrounding water 9 will influence the pressure sensing valve 20 to take a second end position in which it once again closes such that air cannot discharge through its outlet L10. The pressure sensing valve 20 will however maintain a connection through the outlet L10 if initiation already has been commenced when the diver passes the lower actuation depth D2. Accordingly, the mechanism is not automatically deactivated by the diver entering a zone below the lower actuation depth D2, but also in this case the triggering mechanism is deactivated only in connection with the diaphragm valve 21 sensing breathing, whereby the delay means is reset. If the diver 11 has been in the actuation zone A, e.g. having passed through the actuation zone as he sinks due to not having been able to secure surface buoyancy, the actuator 8 continues to be active even after the diver has passed the lower predefined actuation depth D2. Hence, the device is deactivated only when the diver 11 once again breathes in his breathing regulator 4. In other cases, the diving jacket 6 is inflated and lifts the diver 11 to the surface 10.

When the diver is then below the lower actuation depth D2, the actuation mechanism 8 cannot be initiated since the pressure regulating valve 20 is in one of its closed positions.

When the diver then starts ascent and reaches an ascent point c at which the water 9 exerts a pressure on the pressure sensing valve 20 that once again has opened the connection to the outlet L10, driving air will once again be supplied to the diaphragm valve 21. Thereby, the functionality of the actuator 8 is the same as has been described above, as long as the diver is within the actuation zone A. The actuator will not be deactivated again until the diver has ascended to a point d at which the pressure of the surrounding water 9 falls below the predefined upper actuation depth D1. When the diver is at the surface he can accordingly throw out his breathing regulator 4 without risking that the diving jacket 6 inflates without due cause. If the diver on the other hand starts to sink, he would re-enter into the actuation zone A and in that case a deactivation of the actuator 8 can only take place by once again breathing in the breathing regulator 4. According to an alternative embodiment, the pressure sensing valve 20 is arranged such that it only arrests supply through the outlet L10 in connection with the diver leaving the actuation zone A via the lower depth limit D2, while it accordingly disconnects from actuation when the diver leaves the actuation zone A via the upper actuation depth D1. Hereby, the risk of the diving jacket 6 being inflated by error if the diver 11 after a successful ascent and before final ascent makes a brief descent, i.e. by mistake ends up in the actuation zone A just before ascent, is eliminated.

According to one embodiment according to the invention, the delay means 22 is constituted by a mechanical device comprising a hydraulic delay chamber (not shown). The hydraulic delay chamber allows an adjusting means of the delay means to move at different speeds in the two directions, by allowing a larger liquid flow through in one direction and a smaller liquid flow through in the other direction. Depending on from which conduit L20, L21 that the pressurized air acts on the hydraulic delay chamber, the adjusting means will accordingly move at different speed. When the pressurized air affects from the third conduit L20, the adjusting means will move from start mode in a direction towards trigger mode, whereby a considerably much smaller flow is allowed than if the pressurized air affects via the second conduit L21. This means that the hydraulic delay chamber will operate as a timer, for which the time for the delay means to move from start mode to trigger mode can be chosen by controlling the flow resistance in the respective direction.

Suitably, the time is chosen such that in case the diver does not breathe in the breathing regulator, the delay chamber should shift from start mode to trigger mode within 30 seconds, preferably within 20 seconds. If the diver during that time finds his breathing regulator 4 or alternatively breathes as usual in the breathing regulator when he is in the actuation zone A, the breathing will cause a pressure drop in the second connection L1*b*, which affects the diaphragm controlled valve 21 to redirect the air to the fourth connection L21. When the pressurized air affects this side S2 of the liquid filled delay chamber, a considerably much larger flow opens up through the delay chamber and this means that in the short time period that is required for the diver to inhale air, the liquid controlled delay chamber will be shifted to start mode and the safety function will be reset to start mode. This procedure is repeated as long as the diver is in the actuation zone A, since then the pressure valve 20 will supply driving air to the diaphragm controlled valve 21, which means that the delay chamber repeatedly starts to move in a direction from start mode to trigger mode as soon as a static pressure is reinstated in L1*b*, affecting the diaphragm valve 21 to guide the air towards the first side S1. The diver's breathing in the breathing regulator 4 will accordingly cause the pressure drop in the second connection L1*b*, which resets the delay chamber.

If on the other hand an emergency situation arises in which the diver does not find his breathing regulator within the predetermined time period, the liquid controlled delay chamber will by influence of the pressurized air be moved from start mode to trigger mode. Upon entry into the trigger position, a sixth connection L3 for pressurized air opens up via the delay chamber and to the trigger valve 23. By influence of the pressurized air via L3, the trigger valve 23 opens and thereby a direct connection L1*c* opens from the valve device 2 to the diver's diving jacket 6, which momentarily starts to inflate. The diver will automatically get the buoyancy needed to float up to surface.

Figure 4:
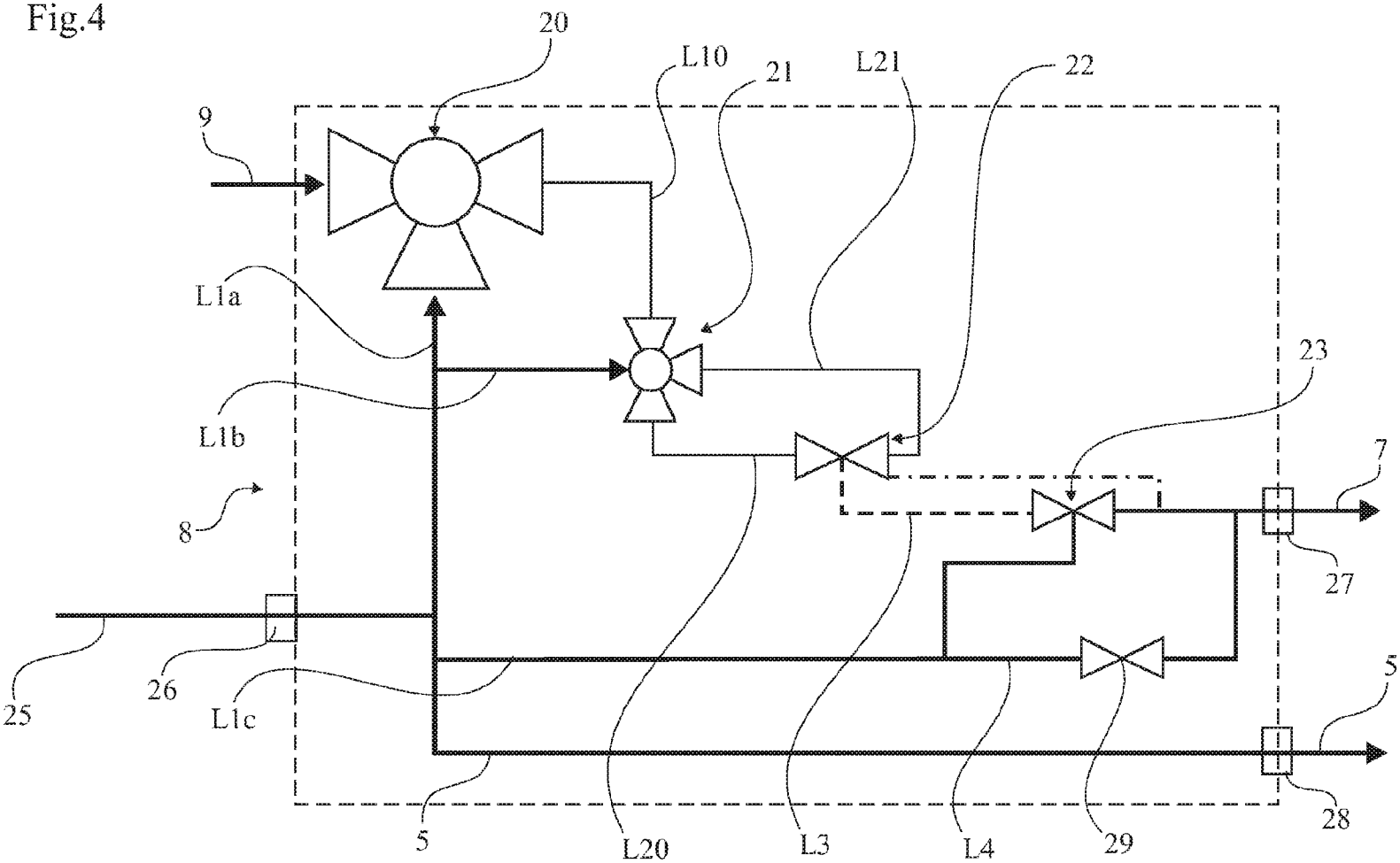
FIG. 4 shows a somewhat modified flowchart over an actuator according to the invention.

FIG. 4 shows an alternative embodiment of an actuator 8 according to the invention. In principle, it has the same built-in functionality as is shown in FIG. 2, which is shown by the same type of components having been given the same reference numbers. The modification according to FIG. 4 consists in that an additional valve 29 has been provided in a conduit L4 of its own, which conduit L4 connects the conduit L1*c* with the tube 7 to the jacket 6, such that it forms a "by-pass" past the trigger valve 23. This additional valve 29 has the functionality that it opens up for automatic inflation of the jacket 6 when the air in the tank 1 is about to run out. Accordingly, the purpose of the valve 29 is to eliminate the risk that the diver runs out of air during a dive, and instead he will be automatically brought up to the surface when the air is about to run out. Hence, the additional valve 29 will control the opening and forming of a connection with any type of sensing able to detect that air is about to run out, e.g. by using a manometer (not shown) to control the additional valve 29 when the operating pressure supplied via the outlet 25 has decreased to a certain level below "normal operating pressure", e.g. to open up at a pressure of 0.5 MPa when the operating pressure, i.e. after the reducing of the reducing valve 111, is set to be about 0.7-0.8 MPa. It is realised that naturally the reducing valve can be arranged inside the house 80 belonging to the actuator 8.

Figure 5:
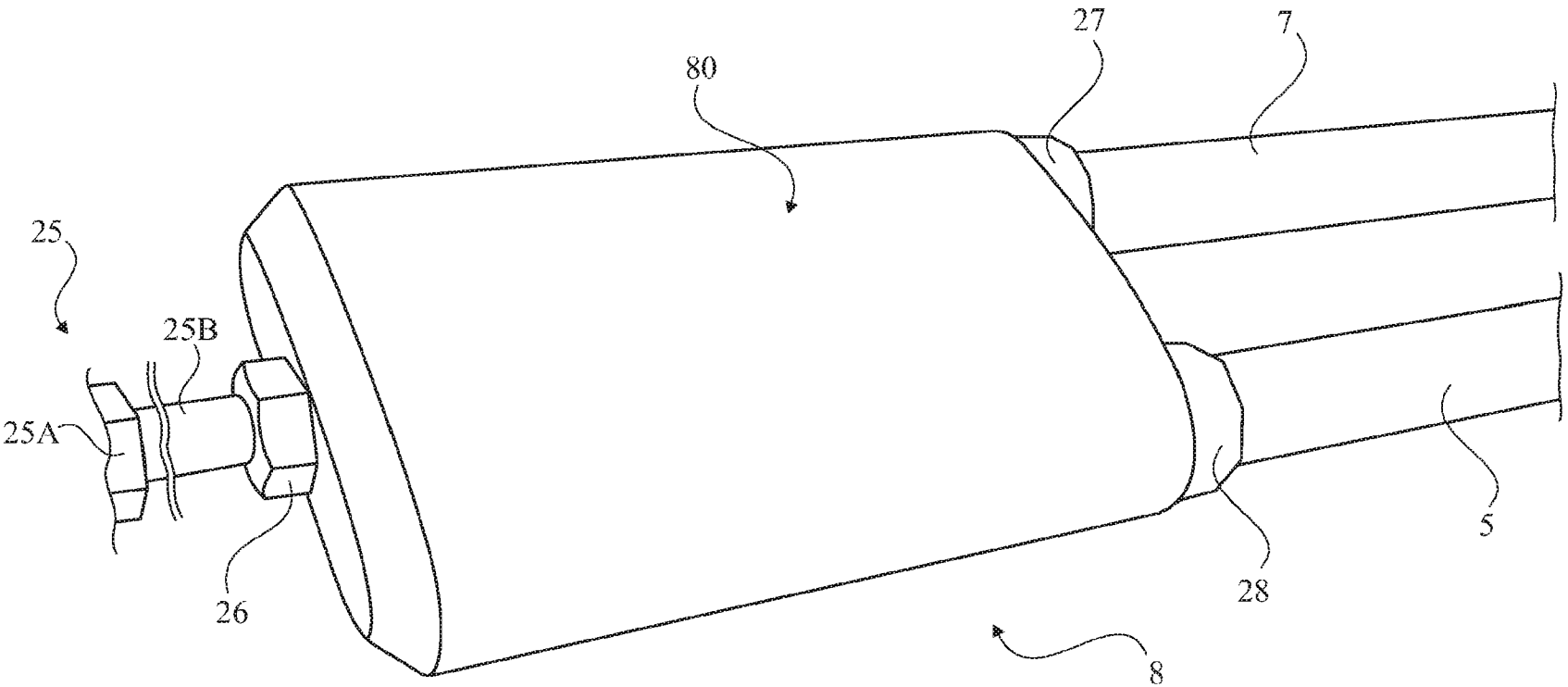
FIG. 5 shows a conceived embodiment of an actuator according to the invention.

FIG. 5 shows a preferred embodiment of an actuator 8 according to the invention. It is clear that the device 8 is a house 80 of relatively small dimensions, which means that the device is easy to bring along thanks to being relatively small and non bulky. The approximate dimensions of the shown embodiment are 100×50×20 mm. The house 80 accommodates the conduits and valves required according to the description above (see FIGS. 3 and 4.) In addition, there are the connections 26, 27, 28 that are necessary to interconnect the device 8 between the pressure tank 1 and the jacket 6 and the breathing regulator 4, respectively. As is known to the person skilled in the art, these connections can be made in many ways known per se, to provide sealing connections. Suitably, the outlet 25 between the actuator 8 and the pressure tank 1 is however provided in the form of a flexible connector 25B (such as a reinforced rubber hose) that by a coupling device 26 (here indicated by a nut coupling but naturally many types of couplings can be used, such as quick couplings), such that any forces that arises and that act on the actuator 8 (e.g. in the form of blows or bending stresses) will not result in high stress on any of the coupling devices 26, 25A, but instead will be absorbed/dampened by the flexible connector 25B. Moreover, the coupling 27 to the jacket may advantageously be a quick coupling known per se, which comprises a closing mechanism as soon as the coupling is taken apart (normally a spring loaded ball that seals against a seat, which ball opens up/is pushed away when coupling takes place). Thanks to this built-in functionality, the hose 7 to the jacket can if desired always be detached, even below surface, without affecting the rest of the equipment or the functionality.

The person skilled in the art will realise that the invention should not be limited to the examples above, but the scope of the concept according to the invention comprises a large variety of elements and devices having the same functionality and being able to achieve the same purpose. It is realised for example that the actuator can be equipped with electronic sensors and regulators such as electronic pressure sensors, timing blocks, etc. It is realised for example that the breathing sensing means 21 can be composed of a variety of other devices than those described above. An obvious modification is to arrange some type of flow-sensing means in the hose 5 or inside the breathing regulator 4, such as a mechanical device that indicates the emergence of a flow, e.g. a small impeller the rotation of which is detected in order to reset the delay means 22. It is also realised that modifications in respect of the control and regulation functions of the actuator can be made within the scope of the invention. It may be desirable e.g. for an instructor in connection with training to be able to determine when the device should be activated and when not, and hence it is conceivable for the device to comprise means for remote actuation. This can be made such that the dive leader has a (small) computer unit with a display (e.g. a "personal digital assistant (PDA)" or the like) that communicates with breathing sensing means arranged in connection with each breathing regulator 4, which means gives an alarm signal if a diver has not breathed in his regulator for a predetermined time period, whereby the dive leader, by aid of a remote actuation means (suitably the same unit that gives the alarm signal, e.g. the same personal digital assistant (PDA), can initiate the trigger valve 23 to open up in order for the diving jacket 6 of the equipment that gave the alarm signal (or all equipments) to inflate. Hence, it is realised that initiation of inflation of the diving jacket 6 can take place in many other ways than those exemplified above. It is also realised that the principles of the invention can be used also in connection with non conventional diving equipment, such as the case in which the diver employs a pressure tank only containing a small amount of air and that thereby doesn't need to be carried as a backpack but can be held by the diver's mouth such that no hose is necessary between the pressure tank and the breathing regulator 4. Often, such a pressure tank 1 may contain an amount of air that is insufficient to secure inflation of the diving jacket 6.

In that case, the diving jacket 6 can instead be provided with releasable ampoules that in connection with initiation will inflate the jacket with a suitable gas in order to provide sufficient buoyancy. Of course, it is possible to use a combination of the last mentioned features, whereby the breathing regulator 4 is in electronic contact with an actuator 8 that is able to activate the interconnection from a conventional pressure tank 1, and/or ampoules according to the above. It is furthermore realised that the pressure sensing means coupled to the actuator need not be able to be mechanically affected, but instead an electronic pressure sensing means, e.g. in combination with a piezo-electric pressure sensor, can be used which controls the air supply to a valve mechanism with the same type of functionality as the diaphragm valve 21 described above. According to the same line of thought, it is realised that also the delay mechanism can be arranged to be completely electronic, for example by building in a timer function that fulfils the desired functionality, this too for example in combination with a piezo-electric pressure sensor. It is furthermore realised that many of these functions can be picked from dive computers existing today, accordingly enabling synergistic combinations. Another synergistic effect is that settings for e.g. the actuation zone, delay time etc. are easy to change in a flexible manner. For training purposes it can also be desirable to provide a device that allows for testing the function on shore and accordingly it may be of interest to activate the device manually. According to yet another aspect, it may be desirable to be able to increase the actuation zone, suitably coupled to some other conditions. An actuation zone that is deeper than the above given may in combination with a partial inflation of the diving jacket (which as such will result in a slow ascent to the surface) results in that the diver is transported to the surface instead of disappearing in the depth. Hereby, rescue operations can be performed in a considerably shorter time than what would otherwise be the case.

According to a modification of the invention, it can be used also to secure that persons who have drowned are brought to the surface, which is often a strong desire for the relatives. This can be achieved by coupling an additional function to said other functionalities, which function initiates triggering of the trigger valve 23 when a certain longer time period has elapsed, such as one hour, with the condition that breathing has not taken place in the breathing regulator 4 and suitably also with the condition that the pressure sensing means has not been exposed to a pressure corresponding to atmospheric pressure during this time period.

The invention claimed is:

1. A safety method in connection with self contained underwater breathing apparatus (SCUBA) diving to control a diver's buoyancy, the method comprising:

equipping the diver with diving equipment comprising at least one air pressure tank, a valve device connected to the pressure tank and arranged to supply air from said pressure tank via first supply means to a breathing regulator and via second supply means to an inflatable diving jacket in order to control the diver's buoyancy, an actuator being able to automatically initiate inflation of the diving jacket when the diver has not affected an air flow through the breathing regulator for a certain time period, wherein said actuator is controlled by an actuation mechanism that automatically sets the actuator in active mode when the diver is within an actuation zone, wherein said actuation zone is defined by an upper actuation depth and a lower actuation depth, and said upper actuation depth is positioned immediately below a water surface to 1.0 m below the water surface.

2. A safety method according to claim 1, wherein said upper actuation depth is positioned 0.1 to 0.5 m below the water surface.

3. A safety method according to claim 1, wherein said upper actuation depth is positioned 0.1 to 0.3 m below the water surface.

4. A safety method according to claim 1, wherein said upper actuation depth is positioned about 0.2 m below the water surface.

5. A safety method according to claim 1, wherein said lower actuation depth corresponds to a depth of down to 200 m below a water surface.

6. A safety method according to claim 5, wherein said lower actuation depth corresponds to a depth immediately above the depth for safety stops during ascent to the water surface.

7. A safety method according to claim 5, wherein said lower actuation depth corresponds to a depth of about 2 to 5 m below a water surface.

8. A safety method according to claim 5, wherein said lower actuation depth is a depth of about 2 to 3.5 m below the water surface.

9. A safety method according to claim 5, wherein said lower actuation depth is a depth of about 2.5 m below the water surface.

10. A safety method according to claim 1, wherein the actuator comprises a pressure sensing means that detects a depth of the diver.

11. A safety method according to claim 1, wherein said supply means comprises a first hose and a second hose that are directly or indirectly connected with said valve device.

12. A safety method according to claim 11, wherein said actuator is fitted to the diving equipment and comprises at least one mechanical valve device in fluid communication between the valve device and at least said second hose.

13. A safety method according to claim 12, wherein the actuator comprises a trigger valve connected to said second hose and controlled by a delay means, and breathing sensing means adapted to reset said delay means.

14. A safety method according to claim 13, wherein the actuator comprises pressure sensing means comprising a governor valve arranged to activate air supply when the diver is within the actuation zone defined by the upper actuation depth and the lower actuation depth.

15. A safety method according to claim 14, wherein said delay means , in a trigger mode, opens up a trigger connection from the delay means to the trigger valve, whereby pressurized air from the valve device inflates the diving jacket.

16. A safety method according to claim 15, wherein a time period (TI) for delay from the start mode to the trigger mode is 10-100 times longer than a resetting time required for resetting to start mode, which resetting time is not more than 2 seconds.

17. A safety method according to claim 16, wherein a time period (TI) for delay from start mode to the trigger mode is 10-20 times longer than a resetting time required for resetting to the start mode, which resetting time is not more than 1.5 seconds.

18. A safety method according to claim 17, wherein the resetting time is not more than 1 second.

19. A safety method according to claim 16, wherein said breathing sensing means comprises a diaphragm controlled valve that maintains a first mode as long as the static pressure in a connection in communication with said first hose is kept constant due to the diver not breathing in the breathing regulator.

20. A safety method according to claim 1, wherein said actuator is arranged to be connected to a coupling device comprising a reducing valve.

21. A safety device arranged to be connected to diving equipment comprising:

at least one air pressure tank;

an inflatable diving jacket;

a valve device connected to the pressure tank and arranged to supply air from at least one said pressure tank via first supply means to a breathing regulator and via second supply means to the inflatable diving jacket in order to control a diver's buoyancy;

means for sensing breathing through said breathing regulator;

an actuator arranged to automatically initiate inflation of the diving jacket when an air flow through the breathing regulator has ceased for a certain time period; and an actuation mechanism arranged in connection with said actuator to automatically indicate that the diver is within an actuation zone, wherein said actuation zone is defined by an upper actuation depth and a lower actuation depth, and said upper actuation depth is positioned immediately below a water surface to 1.0 m below the water surface.

22. A safety device according to claim 21, wherein said supply means comprises a first hose and a second hose that are directly or indirectly connected with said valve device, and wherein said actuator is arranged to communicate with said valve device to initiate inflation of the diving jacket.

23. A safety device according to claim 21, wherein said valve device and/or actuator comprises a pressure reducing device.

24. A safety device according to claim 21, wherein said valve device and said actuator are integrated in a single unit.

* * * * *